US010618091B2

(12) United States Patent
Justen et al.

(10) Patent No.: US 10,618,091 B2
(45) Date of Patent: Apr. 14, 2020

(54) ROLLING OF ROLLING MATERIAL WITH TENSION CHANGE AT THE ROLLING OF THE TAIL END OF THE ROLLING MATERIAL

(71) Applicant: Primetals Technologies Germany GmbH, Erlangen (DE)

(72) Inventors: Cristiano Justen, Shrewsbury, MA (US); Yun Ling, Shrewsbury, MA (US); Paul Barry Riches, Paxton, MA (US)

(73) Assignee: PRIMETALS TECHNOLOGIES GERMANY GMBH, Erlangen (DE)

( * ) Notice: Subject to any disclaimer, the term of this patent is extended or adjusted under 35 U.S.C. 154(b) by 345 days.

(21) Appl. No.: 15/540,525

(22) PCT Filed: Dec. 30, 2014

(86) PCT No.: PCT/US2014/072778
§ 371 (c)(1),
(2) Date: Jun. 28, 2017

(87) PCT Pub. No.: WO2016/108852
PCT Pub. Date: Jul. 7, 2016

(65) Prior Publication Data
US 2018/0001362 A1 Jan. 4, 2018

(51) Int. Cl.
*B21B 37/46* (2006.01)
*B21B 37/52* (2006.01)
*B21B 1/16* (2006.01)

(52) U.S. Cl.
CPC ..... *B21B 37/46* (2013.01); *B21B 1/16* (2013.01); *B21B 37/52* (2013.01);
(Continued)

(58) Field of Classification Search
CPC ..... B21B 1/16; B21B 35/04; B21B 37/46; B21B 37/52; B21B 38/00; B21B 2273/16;
(Continued)

(56) References Cited

U.S. PATENT DOCUMENTS 4,286,447 A * 9/1981 Peterson ..... B21B 37/46 72/9.4
4,537,055 A * 8/1985 Woodrow ..... B21B 35/02 248/676

(Continued)

FOREIGN PATENT DOCUMENTS

CN 1280040 A 1/2001
CN 102869460 A 1/2013

(Continued)

OTHER PUBLICATIONS

Astrom, Karl and Hagglund, Tore. "Advanced PID Control", ISA—Instrumentation, Systems, and Automation Society, 2006, pp. 1-3. (Year: 2006).*

(Continued)

*Primary Examiner* — Adam J Eiseman
*Assistant Examiner* — Mohammed S. Alawadi
(74) *Attorney, Agent, or Firm* — Staas & Halsey LLP

(57) ABSTRACT

During rolling of front sections of rolling material in a rear group of roll stands of a rolling mill, rear sections of the rolling material are rolled in the front group of roll stands. A run-out speed with which the rolling material is exiting the front group of roll stands is detected. A run-in speed with which the rolling material is entering the rear group of roll stands is detected. A rolling speed with which the rear group of roll stands is driven is controlled by a controller such that a relation of the run-in speed to the run-out speed equals a predetermined value. The predetermined value is kept constant until a time point at which a tail end of the rolling (Continued)

material reaches a predetermined location upstream of the front group of roll stands, and is changed according to a predetermined function after the time point.

20 Claims, 3 Drawing Sheets

(52) U.S. Cl.
CPC ..... *B21B 2265/06* (2013.01); *B21B 2273/16* (2013.01); *B21B 2275/06* (2013.01)

(58) Field of Classification Search
CPC ..... B21B 2263/20; B21B 2265/06; B21B 2275/02; B21B 2275/06
USPC ..... 72/12.6
See application file for complete search history.

(56) References Cited

U.S. PATENT DOCUMENTS 4,656,856 A * 4/1987 Voye, Jr. ..... B21B 37/52 72/11.4
5,325,697 A * 7/1994 Shore ..... B21B 1/18 72/234
6,148,653 A * 11/2000 Sako ..... B21B 37/52 72/11.4
6,167,736 B1 1/2001 Shore
2002/0177972 A1* 11/2002 Riches ..... B21B 37/52 702/142

FOREIGN PATENT DOCUMENTS

| | | |
|---|---|---|
| CN | 103260780 A | 8/2013 |
| EP | 0 967 025 A1 | 12/1999 |
| JP | 62-24810 | 2/1987 |

OTHER PUBLICATIONS

PCT/US2014/072778, Dec. 20, 2014, Justen et al., Primetals Technologies Germany GMBH
International Search Report for PCT/US2014/072778 dated Sep. 21, 2015.
Chinese Office Action dated May 18, 2018 in corresponding Chinese Patent Application No. 201480084481.7, 7 pgs.

* cited by examiner

ROLLING OF ROLLING MATERIAL WITH TENSION CHANGE AT THE ROLLING OF THE TAIL END OF THE ROLLING MATERIAL

CROSS REFERENCE TO RELATED APPLICATIONS

This application is the U.S. national stage of International Application No. PCT/EP2014/072778, filed Dec. 30, 2014 and claims the benefit thereof which is incorporated by reference herein in its entirety.

BACKGROUND

Described below is a method for rolling a rolling material in a rolling mill, wherein the rolling material is rolled firstly in roll stands of a front group of roll stands of the rolling mill and then in roll stands of a rear group of roll stands of the rolling mill, wherein during rolling of front sections of the rolling material in the roll stands of the rear group of roll stands, rear sections of the rolling material are rolled in the roll stands of the front group of roll stands, wherein the rear group of roll stands includes a plurality of roll stands which are driven by a drive common to the roll stands of the rear group of roll stands.

An example a method known to the person skilled in the art, is described in U.S. Pat. No. 6,167,736 B1.

Also described below is a computer program with program code which is executable by a control device for a rolling mill wherein executing the program code by the control device effects the implementation of the method described below.

A control device for a rolling mill is also described below, wherein the control device is programmed with such a computer program so that the control device controls the rolling mill according to such the method.

In addition, a rolling mill for rolling a rolling material is described below, wherein the rolling mill has a front group of roll stands and a rear group of roll stands, wherein the rolling mill has a control device controlling the rolling mill according to such a method.

During rolling of rolling material—especially during rolling of rod-shaped or bar-shaped rolling material—it may occur that during rolling of the tail end of the rolling material and of sections of the rolling material next to the tail end that the rolling material exits the front group of roll stands with a too large cross-section. This change of cross-section causes a change of tension in the rolling material between the front group and the rear group of roll stands. In many cases the change of tension in combination with the change of cross-section effects that after exiting the rear group of roll stands, the cross-section of the corresponding sections of the rolling material is outside of permitted tolerances. In such a case the corresponding sections of the rolling material have to be scrapped.

In the related art, the tension is adapted by a user by manually changing a rolling speed of the roll stands of the rear group of roll stands. By this method, however, often only unsatisfying results are achieved. Furthermore, the result is dependent on the experience of the user.

SUMMARY

Described below are solutions by which in a reliable manner not only the main part but also the tail end and the sections of the rolling material next to the tail end are rolled properly, i.e. having a cross-section within permitted tolerances.

A method of the above-mentioned type is augmented in that the front group of roll stands includes a plurality of roll stands which are driven by a drive common to the roll stands of the front group of roll stands, that a run-out speed with which the rolling material is exiting the front group of roll stands is detected, that a run-in speed with which the rolling material is entering the rear group of roll stands is detected, that a rolling speed with which the rear group of roll stands is driven is controlled by a controller such that a relation of the run-in speed to the run-out speed equals a predetermined value, that the predetermined value is kept constant until a time point at which a tail end of the rolling material reaches a predetermined location upstream of the front group of roll stands, and is increased according to a predetermined function after the time point.

In principle, the rolling material may have any shape. For example, the rolling material may be a flat material (strip or plate), a pipe shaped rolling material (starting from a bloom) or a profile (starting from a billet). Often, the rolling material is a rod-shaped or bar-shaped material (also starting from a billet).

The front group of roll stands is usually a so-called no twist-mill and the rear group of roll stands is usually a so-called reducing sizing mill or a sizing mill. The terms "no twist-mill" and "reducing sizing mill" have a specific technical meaning for the person skilled in the art, see for example for "no twist-mill" U.S. Pat. No. 4,537,055.

In many cases the rolling material is rolled prior to rolling in the roll stands of the front group of roll stands in roll stands of an additional group of roll stands of the rolling mill, the additional group of roll stands being located upstream of the front group of roll stands. In this case, the predetermined location may be arranged immediately upstream of the additional group of roll stands. This embodiment assures that there is sufficient time to increase the rolling speed of the roll stands of the rear group of roll stands before the tail end enters the front group of roll stands. In case the additional group of roll stands includes a plurality of roll stands and each of these roll stands may be driven by a drive of its own.

As described below, beginning at the time point at which the tail end of the rolling material reaches the predetermined location upstream of the front group of roll stands, a feed forward control signal stored in a memory may be added to the output signal of the controller and the feed forward control signal stored in the memory may be modified in dependency on the output signal of the controller. Alternatively, these signal adjustments can begin at the time point at which the predetermined value is increased. By this embodiment, a superior control of rolling speed, tension and cross-section of the rolling material can be achieved.

A rolling material speed of the rolling material immediately upstream of the front group of roll stands may be detected and the predetermined function may be adapted in dependency on the deviation of the detected rolling material speed from a reference speed. By this embodiment, speed deviations can easily be compensated for. The controller may, in principle, be any controller, such as a PID-controller.

BRIEF DESCRIPTION OF THE DRAWINGS

The features, properties and advantages discussed above will be understood more easily by the following description of exemplary embodiments which are explained with reference to the accompanying drawings of which.

DETAILED DESCRIPTION OF THE PREFERRED EMBODIMENT

Figure 1:
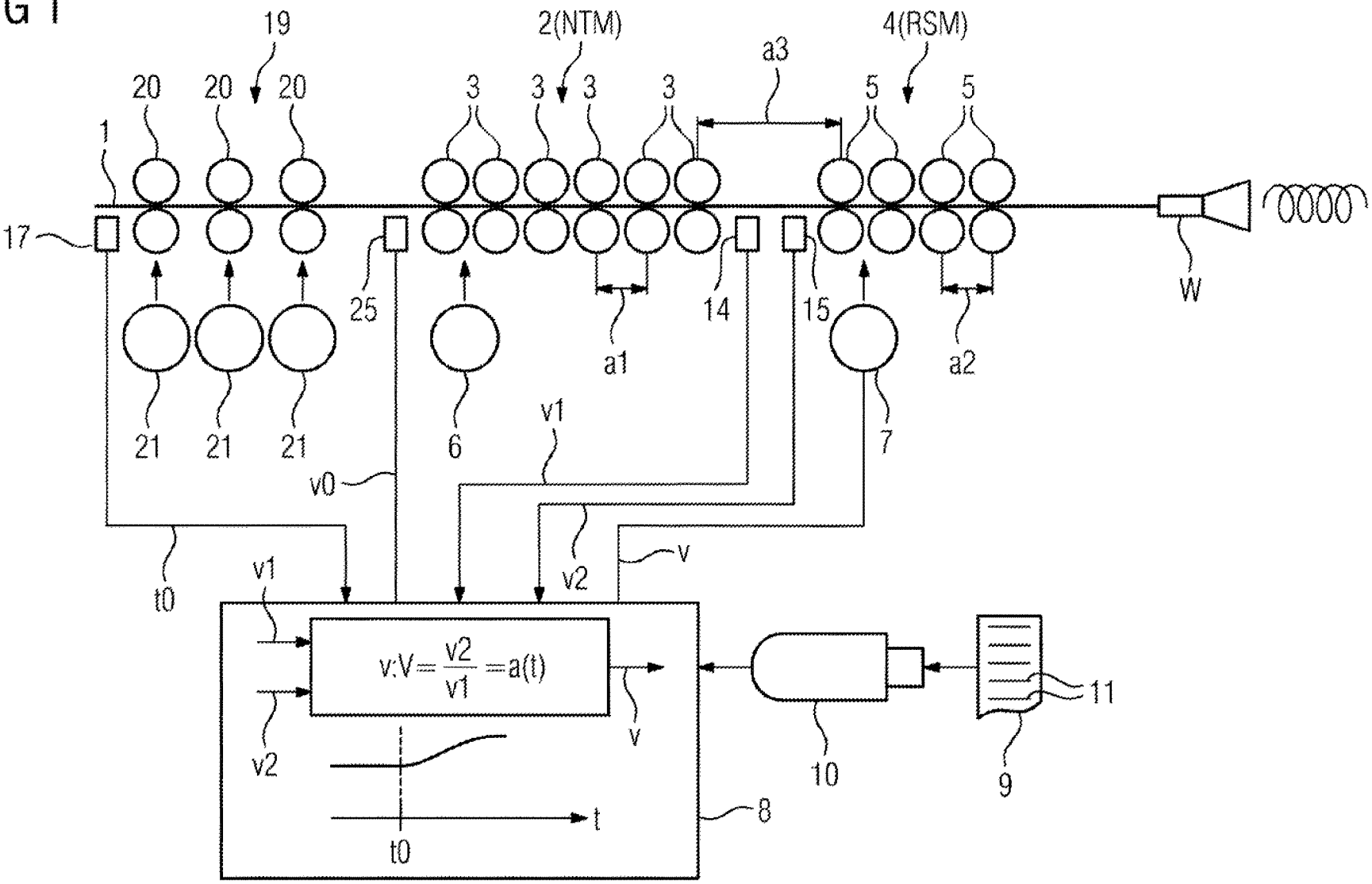
FIG. 1 is a schematic side view of a rolling mill having several groups of roll stands.

As shown in FIG. 1, a rolling mill for rolling a rolling material 1 has a front group 2 of roll stands 3 and a rear group 4 of roll stands 5.

As shown in FIG. 1, the front group 2 of roll stands 3 includes a plurality of roll stands 3 which are driven by a drive 6 common to the roll stands 3 of the front group 2 of roll stands 3. The roll stands 3 of the front group 2 of roll stands 3 therefore are separated only by a small distance a1, for example a distance a1 in the range between 0.50 m and 1.50 m.

The rear group 4 of roll stands 5 in the embodiment of FIG. 1 also includes a plurality of roll stands 5 which are driven by a drive 7 common to the roll stands 5 of the rear group 4 of roll stands 5. The roll stands 5 of the rear group 4 of roll stands 3 therefore are also separated only by a small distance a2, for example a distance a2 in the range between 0.50 m and 1.50 m.

A distance a3 between the roll stands 3 of the front group 2 of roll stands 3 and the roll stands 5 of the rear group 4 of roll stands 5 often is in the range of several metres, for example in the range between 10.0 m and 20.0 m. Between the roll stands 3 of the front group 2 of roll stands 3 and the roll stands 5 of the rear group 4 of roll stands 5, however, there is no additional roll stand. Further, in this area, there is no looper.

The rolling mill further has a control device 8. The control device 8 is programmed by a computer program 9. The computer program 9 may be provided to the control device 8 for example via a data carrier 10 on which the computer program 9 is stored in (exclusively) machine-readable form—for example in electronic form. The computer program 9 is formed of machine code 11 executable by the control device 8. By executing the machine code 11, the control device 8 operates the ref-rolling mill according to a method which will be explained in detail below.

Control of the rolling mill by the control device 8 effects that the rolling material 1 is rolled in the rolling mill. The rolling material 1 is rolled firstly in the roll stands 3 of the front group 2 of roll stands 3 of the rolling mill. Then the rolling material 1 is rolled in the roll stands 5 of the rear group 4 of roll stands 5 of the rolling mill.

Figure 2:
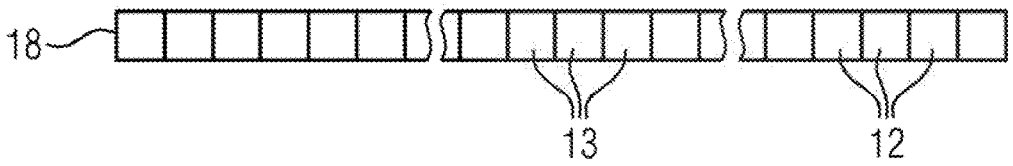
FIG. 2 is a strip of boxes representing several groups of roll stands and a rolling material.

As shown in FIG. 2, the rolling material 1 is extending over a significant length. The length of the rolling material 1 is so large that, as shown in FIGS. 1 and 2, during rolling of front sections 12 of the rolling material 1 in the roll stands 5 of the rear group 4 of roll stands 5, rear sections 13 of the rolling material 1 are rolled in the roll stands 3 of the front group 2 of roll stands 3. The feature that a predetermined section 12, 13 of the rolling material 1 is a front section 12 or a rear section 13, respectively, is not static. It refers to a defined point of time at which the respective section 12, 13 is rolled in the roll stands 5 of the rear group 4 of roll stands 5 or in the roll stands 3 of the front group 2 of roll stands 3.

As shown in FIG. 1, a run-out speed v1 is measured by a front velocimeter 14. The run-out speed v1 is the speed with which the rolling material 1 is exiting the front group 2 of roll stands 3. As further shown in FIG. 1, a run-in speed v2 is measured by a rear velocimeter 15. The run-in speed v2 is the speed with which the rolling material 1 is entering the rear group 4 of roll stands 5.

The measured velocities v1, v2 are provided to the control device 8. The control device 8 determines a rolling speed v by which the rear group 4 of roll stands 5 is driven. Especially, the control device 8 implements a controller 16. The controller 16 in the control device 8 sets the rolling speed v such that a relationship V of the run-in speed v2 to the run-out speed v1 takes a predefined value a. This will be explained later in more detail with reference to FIG. 4.

The measured velocities v1, v2 may be used also to trigger and to terminate the execution of the method. Reason is that the execution of the method is meaningful only if and as long as the rolling material 1 is rolled both in the front group 2 of roll stands 3 and in the rear group 4 of roll stands 5. In the case the front group 2 of roll stands 3 includes several roll stands 3, it is sufficient that the rolling material 1 is rolled in the roll stand 3 proximate to the rear group 4 of roll stands 5. Similarly, in the case the rear group 4 of roll stands 5 includes several roll stands 5, it is sufficient that the rolling material 1 is rolled in the roll stand 5 proximate to the front group 2 of roll stands 3. Especially, the execution of the method therefore is triggered by detecting a run-in speed v2 different from 0 by the rear velocimeter 15. Further, the execution of the method is terminated by detecting a run-out speed of 0 by the front velocimeter 14.

A material detecting device 17—for example a detector for detecting the presence of hot metal—detects when a tail end 18 (see FIG. 2) of the rolling material 1 reaches a predetermined location upstream of the front group 2 of roll stands 3. The predetermined location may be determined as required. In many cases, however, the rolling material 1 is rolled prior to rolling in the front group 2 of roll stands 3 in roll stands 20 of an additional group 19 of roll stands 20 of the rolling mill. In that case, the predetermined location may be located upstream of the additional group 19 of roll stands 20. The location may be, as shown in FIG. 1, be located immediately upstream of the additional group 19 of roll stands 20. Passing the predetermined location by the tail end 18 is detected by the control device 8 based on a corresponding change of the signal provided by the material detecting device 17. The corresponding point of time is given the reference sign t0.

The further group 19 of roll stands 20 usually includes a plurality of roll stands 20. According to FIG. 1 the roll stands 20 of this group 19 of roll stands 20 usually each are driven by a drive 21 of its own.

In many cases additional roll stands are arranged upstream of the additional group 19 of roll stands 20. These roll stands, however, are not shown in FIG. 1 and are also not shown in the other drawings.

As shown in FIG. 1, the predetermined value a is kept constant up to the time point to. After the time point t0 however the predetermined value a is increased according to a predetermined function. After the value a is increased, therefore, it will be always larger than before the time point t0. Further, the increment usually is monotone. The increment can be in one single step, in several steps or continuously. In case of several steps, the transition from step to step may be gradually. Furthermore, it is possible that the increment of the predetermined value a starts as soon as the time point t0 is reached. Alternatively, it is possible that the increment of the predetermined value a starts only after, beginning with the time point t0, a predetermined delay time expires.

Figure 3A:
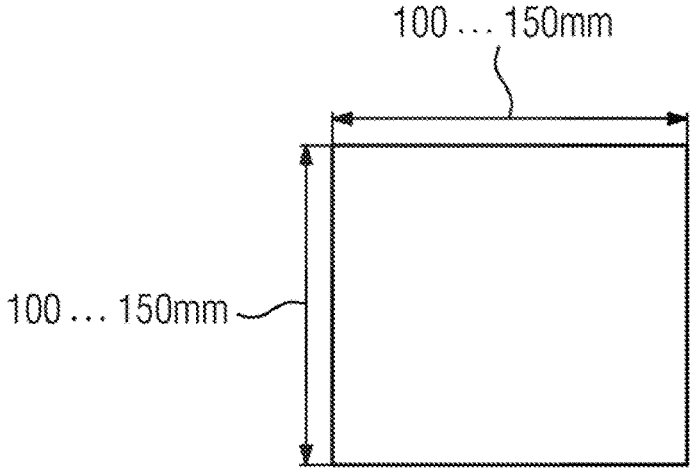
FIGS. 3A and 3B are cross-sections of rolling materials.
Figure 3B:
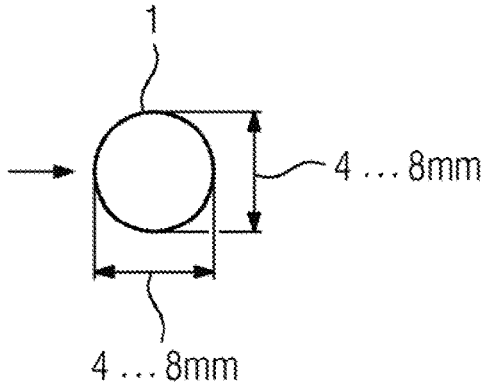

As shown in FIGS. 3A and 3B, in many cases the rolling material 1 is a rod-shaped or bar-shaped rolling material. It is, starting from a billet, rolled to its final dimensions. The billet may be, for example, in the beginning a rectangular billet—especially a square billet. Its dimensions may be in both directions between 100 mm and 150 mm for example. The final dimensions of the rolling material 1 may be in both directions for example between 1 mm and 10 mm, for example between 4.0 mm and 8.0 mm each. As shown in FIG. 3B, the finished rolling material 1 especially may have a circular cross-section.

In case the rolling material 1 is a rod-shaped or bar-shaped rolling material, the front group 2 of roll stands 3 usually is a no twist-mill, as described in U.S. Pat. No. 4,537,055 A. Furthermore, in that case usually the rear group 4 of roll stands 5 is a reducing sizing mill or a sizing mill. Further, in the case of a rod-shaped material, as shown in FIG. 1, a laying head W may be arranged downstream the rear group 4 of roll stands 5.

Figure 4:
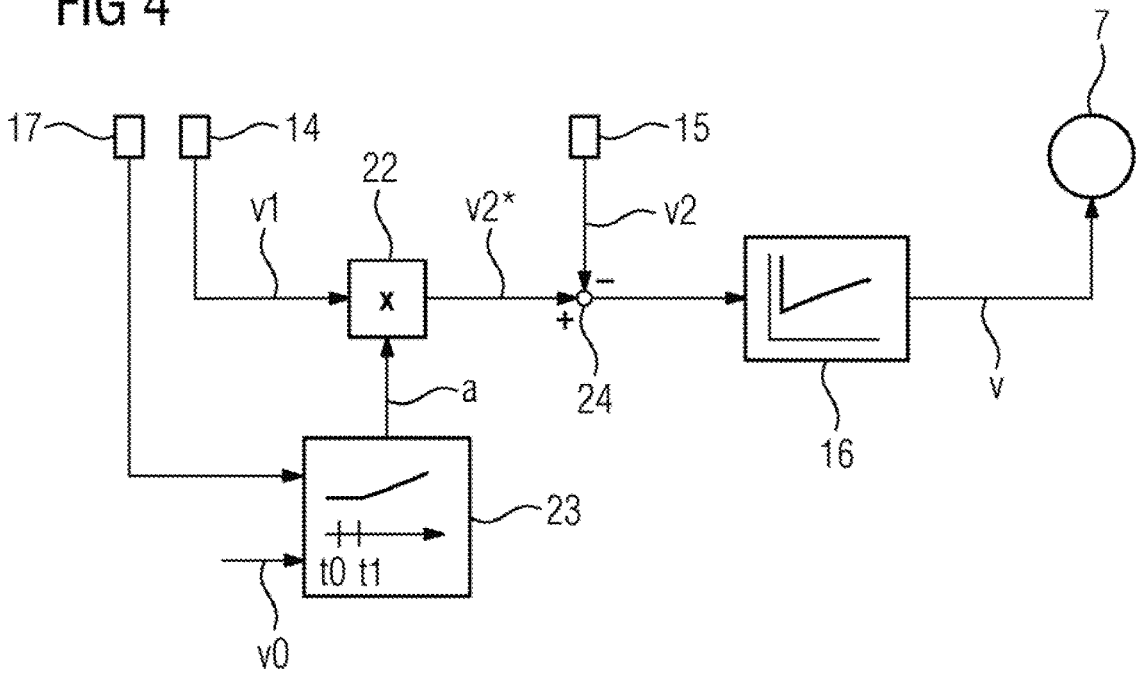
FIG. 4 is a block diagram of a control system.

FIG. 4 shows in detail the calculation of the rolling speed v for the rear group 4 of roll stands 5. As shown in FIG. 4, the run-out speed v1 detected by the front velocimeter 14 is provided to a multiplier 22. Further, a function generator 23 inputs the predetermined value a to the multiplier 22. The multiplier 22 determines as output signal the product of the run-out speed v1 and the predetermined value a. The output signal of the multiplier 22 corresponds to a setpoint value v2* for the run-in speed v2. The setpoint value v2* and the run-in speed v2 detected by the rear velocimeter 15 are input to a node 24. The node 24 determines the difference between the setpoint value v2* and the run-in speed v2. This difference is provided to the controller 16 as input signal. The controller 16 determines, starting from this input signal, the rolling speed v. According to the determined rolling speed v, the drive 7 of the rear group 4 of roll stands 5 is controlled.

In FIG. 4, the controller 16 may be a proportional-integral-derivative or PID-controller. Other embodiments of the controller 16 are also possible.

The output signal of the material detecting device 17 is further provided to the function generator 23. If the function generator 23 determines, based on this signal, that the tail end 18 has reached the predetermined location (according to FIG. 1 a location upstream of the roll stands 20 of the additional group 19 of roll stands 20), this effects that the function generator 23 increases the predetermined value a according to the predetermined function. The predetermined function may be determined in a way that the predetermined value a is increased immediately and at once starting at the time point t0 at which the tail end 18 reaches the predetermined location. Alternatively, however, it is possible that—after the time point t0—the predetermined value a is kept constant yet and is increased at a later time point t1. In that case, the difference in time between the time point t0 at which the tail end 18 reaches the predetermined location and the later time point t1 at which the increasing of the predetermined value starts is determined by the predetermined function.

As in the embodiment illustrated in FIG. 1, an additional velocimeter 25 may detect a rolling material speed v0. The rolling material speed v0 is the speed of the rolling material 1 immediately upstream of the front group 2 of roll stands 3. In that case, the detected rolling material speed v0 is provided to the function generator 23. In this case, the function generator 23 adapts the predetermined function in dependency on the deviation of the detected rolling material speed v0 from a reference speed. For example, the function generator 23 may scale the predetermined function in time according to the deviation.

Figure 5:
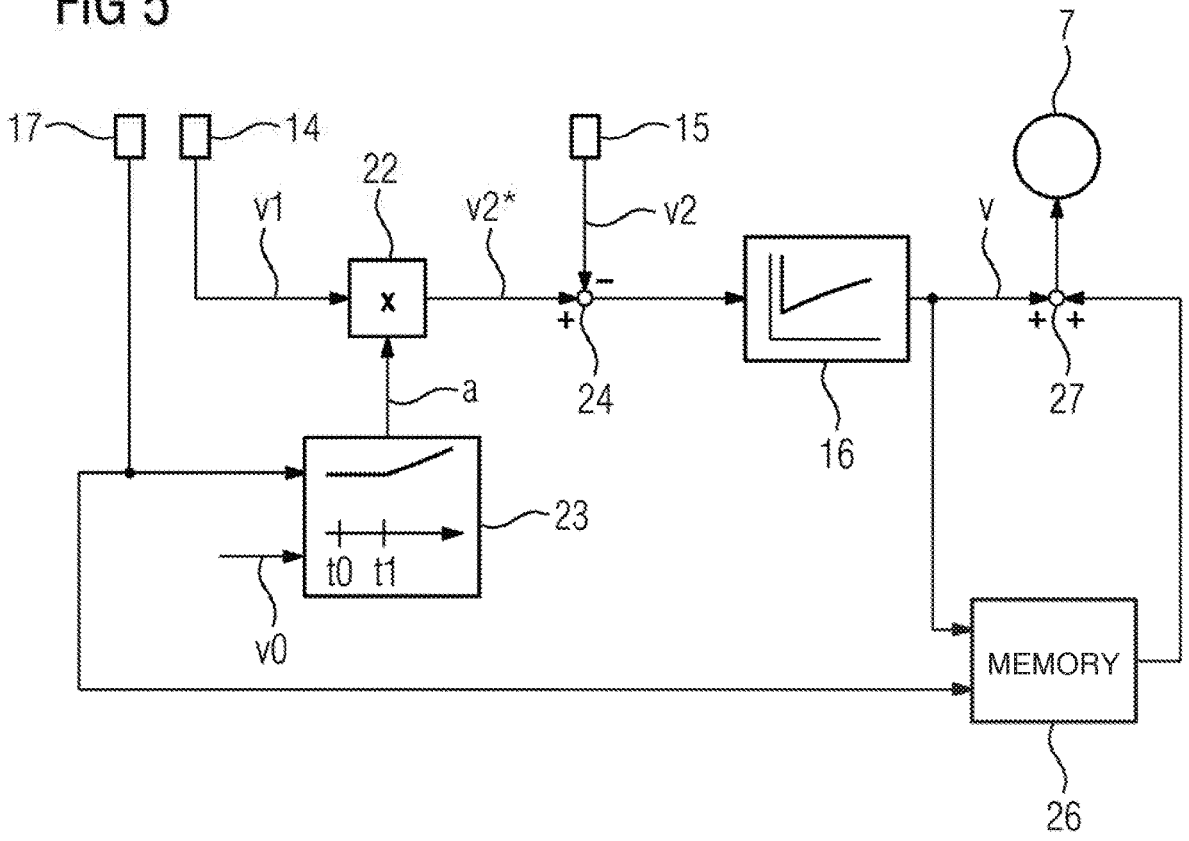
FIG. 5 is a block diagram of a modification of the control system of FIG. 4.

FIG. 5 illustrates an embodiment of FIG. 4. In the embodiment of FIG. 5 the controller 16 is—as in the embodiment of FIG. 4—a PID-controller. As in the embodiment of FIG. 4, also in the embodiment of FIG. 5 other embodiments of the controller 16 are possible. In the embodiment of FIG. 5, there is in addition to the elements of FIG. 4 a memory 26. The memory 26 may be a shift register, for example. In case of the embodiment of FIG. 5, the output signal of the material detecting device 17 is provided not only to the function generator 23 but also to the memory 26. This effects that in a node 27 a feed forward signal stored in the memory 26 is added to the output signal of the controller 16. Further, the output signal of the controller 16 is not only output to the drive 7 or the node 27, respectively, but also provided to the memory 26. The memory 26 therefore is able to modify the feed forward signal stored in the memory 26 in dependency on the output signal of the controller 16. In the simplest case the output signal of the controller 16 is added to the previously stored feed forward signal. Alternatively, the stored feed forward signal may be adapted gradually. For example, a portion of the difference between the output signal of the controller 16 and the previously stored feed forward signal may be added to the previously stored feed forward signal.

When executing this method for the first time, usually in the memory 26 there is not yet a feed forward signal being stored. In that case, the difference between the method of FIG. 5 and the method of FIG. 4 while executing the method for the first time just is that values are entered into the memory 26. At later executions of this method, however, the feed forward signal stored in the memory 26 effects a feed forward control. The controller 16, therefore, just has to correct a remaining deviation. Alternatively, it is possible that even before the method is executed for the first time precalculated values are stored in the memory 26. In this case, these values are used as feed forward signals when executing the method for the first time.

When rolling a subsequent rolling material 1, it is possible to read out the signals stored in the memory 26 from the memory 26 exactly at the corresponding times. Alternatively, it is possible to read out the respective feed forward signal at an earlier point of time. In this way, it is possible to compensate for the reaction time of the drive 7 of the rear group 4 of roll stands 5. The correct time difference may be determined by experiments.

It is possible to execute the method of FIG. 5—that is the adding of the feed forward signal to the output signal of the controller 16 and the modifying of the stored feed forward signal—starting with the time point t0 at which the tail end 18 of the rolling material 1 reaches the predetermined location upstream of the front group 2 of roll stands 3. Alternatively, it is possible to execute the method of FIG. 5 starting from the time point t1 at which the predetermined value a is increased.

According to the method, rolling material 1 is rolled firstly in roll stands 3 of a front group 2 of roll stands 3 of a rolling mill and then in roll stands 5 of a rear group 4 of roll stands 5 of the rolling mill. The front group of roll stands includes a plurality of roll stands which are driven by a drive common to the roll stands of the front group of roll stands. The rear group of roll stands includes a plurality of roll stands which are driven by a drive common to the roll stands of the rear group of roll stands. During rolling of front sections 12 of the rolling material 1 in the roll stands 5 of the rear group 4 of roll stands 5, rear sections 13 of the rolling material 1 are rolled in the roll stands 3 of the front group 2 of roll stands 3. A run-out speed v1 with which the rolling material 1 is exiting the front group 2 of roll stands 3 is detected. A run-in speed v2 with which the rolling material 1 is entering the rear group 4 of roll stands 5 is detected. A rolling speed v with which the rear group 4 of roll stands 5 is driven is controlled by a controller 16 such that a relation V of the run-in speed v2 to the run-out speed v1 takes a predetermined value a. The predetermined value a is kept constant until a time point t0 at which a tail end 18 of the rolling material 1 reaches a predetermined location upstream of the front group 2 of roll stands 3, and is increased according to a predetermined function after the time point t0.

The present invention has many advantages. Most importantly, the rolling material 1 can be utilized over its full length. It is not necessary to scrap the tail end 18 of the rolling material 1. The so-called overfill of the related art can be avoided. The tension in the rolling material 1 between the front group 2 of roll stands 3 and the rear group 4 of roll stands 5 can be set in a defined way.

The present invention was explained above by a plurality of embodiments. The present invention is, however, not restricted to these embodiments. Variations can be found easily by the person skilled in the art without deviating from the scope of the present invention which shall be defined solely by the attached claims.

A description has been provided with particular reference to preferred embodiments thereof and examples, but it will be understood that variations and modifications can be effected within the spirit and scope of the claims which may include the phrase "at least one of A, B and C" as an alternative expression that means one or more of A, B and C may be used, contrary to the holding in *Superguide v. DIRECTV,* 358 F3d 870, 69 USPQ2d 1865 (Fed. Cir. 2004).

The invention claimed is:

1. A method for rolling a rolling material in a rolling mill having roll stands, comprising:

rolling front sections of the rolling material first in a front group of the roll stands and then in a rear group of the roll stands, the front group of the roll stands including a first set of the roll stands driven by a first drive common to the front group of the roll stands and the rear group of the roll stands including a second set of the roll stands driven by a second drive common to the rear group of the roll stands;

rolling rear sections of the rolling material in the front group of the roll stands during said rolling of the front sections of the rolling material in the rear group of the roll stands;

detecting a run-out speed of the rolling material exiting the front group of the roll stands;

detecting a run-in speed of the rolling material entering the rear group of the roll stands; and controlling, by a controller, having at least one hardware processor, based on a feed-forward signal, a rear group speed with which the rear group of the roll stands is driven, such that a relation of the run-in speed to the run-out speed equals a predetermined value that is kept constant until a location time point at which a tail end of the rolling material reaches a predetermined location upstream of the front group of the roll stands, and is increased according to a predetermined function after the location time point.

2. The method according to claim 1, wherein the rolling material has one of a rod shape and a bar shape.

3. The method according to claim 1, further comprising rolling the rolling material in an additional group of the roll stands, upstream of the front group of the roll stands, prior to said rolling in the front group of the roll stands, and wherein the predetermined location is upstream of the additional group of the roll stands.

4. The method according to claim 1, further comprising:

adding the feed forward control signal stored in a memory to an output signal of the controller, beginning at the location time point or beginning at a value time point at which the predetermined value is increased; and modifying the feed forward control signal stored in the memory in dependence upon the output signal of the controller.

5. The method according to claim 1, further comprising:

detecting a rolling material speed of the rolling material immediately upstream of the front group of the roll stands; and adapting the predetermined function in dependence upon a deviation of the rolling material speed from a reference speed.

6. The method according to claim 1, wherein the controller is a proportional-integral-derivative controller.

7. The method according to claim 2, wherein the front group of the roll stands is a no twist-mill and the rear group of the roll stands is one of a sizing mill and a reducing sizing mill.

8. The method according to claim 7, further comprising rolling the rolling material in an additional group of the roll stands, upstream of the front group of the roll stands, prior to said rolling in the front group of the roll stands, and wherein the predetermined location is upstream of the additional group of the roll stands.

9. The method according to claim 8, wherein the additional group of the roll stands includes a set of independently driven roll stands driven by separate drives, respectively.

10. The method according to claim 9, further comprising:

adding the feed forward control signal stored in a memory to an output signal of the controller, beginning at the location time point or beginning at a value time point at which the predetermined value is increased; and modifying the feed forward control signal stored in the memory in dependence upon the output signal of the controller.

11. The method according to claim 10, further comprising:

detecting a rolling material speed of the rolling material immediately upstream of the front group of the roll stands; and adapting the predetermined function in dependence upon a deviation of the rolling material speed from a reference speed.

12. The method according to claim 11, wherein the controller is a proportional-integral-derivative controller.

13. A non-transitory computer readable medium storing program code executable by a controller to control rolling of a rolling material in a rolling mill having roll stands, by performing a method comprising:

rolling front sections of the rolling material first in a front group of the roll stands and then in a rear group of the roll stands, the front group of the roll stands including a first set of the roll stands driven by a first drive common to the front group of the roll stands and the rear group of the roll stands including a second set of the roll stands driven by a second drive common to the rear group of the roll stands;

rolling rear sections of the rolling material in the front group of the roll stands during said rolling of the front sections of the rolling material in the rear group of the roll stands;

detecting a run-out speed of the rolling material exiting the front group of the roll stands;

detecting a run-in speed of the rolling material entering the rear group of the roll stands; and controlling a rear group speed with which the rear group of the roll stands is driven based on a feed-forward signal, such that a relation of the run-in speed to the run-out speed equals a predetermined value that is kept constant until a location time point at which a tail end of the rolling material reaches a predetermined location upstream of the front group of the roll stands, and is increased according to a predetermined function after the location time point.

14. The non-transitory computer readable medium according to claim 13, wherein the method further comprises:

adding the feed forward control signal stored in a memory to an output signal of the controller, beginning at the location time point or beginning at a value time point at which the predetermined value is increased; and modifying the feed forward control signal stored in the memory in dependence upon the output signal of the controller.

15. The non-transitory computer readable medium according to claim 14, wherein the method further comprises:

detecting a rolling material speed of the rolling material immediately upstream of the front group of the roll stands; and adapting the predetermined function in dependence upon a deviation of the rolling material speed from a reference speed.

16. A control device to control rolling of a rolling material in a rolling mill having roll stands, comprising:

a processor configured for executing program code stored on a non-transitory computer readable medium to perform a method of:

rolling front sections of the rolling material first in a front group of the roll stands and then in a rear group of the roll stands, the front group of the roll stands including a first set of the roll stands driven by a first drive common to the front group of the roll stands and the rear group of the roll stands including a second set of the roll stands driven by a second drive common to the rear group of the roll stands, rolling rear sections of the rolling material in the front group of the roll stands during the rolling of the front sections of the rolling material in the rear group of the roll stands, detecting a run-out speed of the rolling material exiting the front group of the roll stands, detecting a run-in speed of the rolling material entering the rear group of the roll stands, and controlling a rear group speed with which the rear group of the roll stands is driven based on a feed-forward signal, such that a relation of the run-in speed to the run-out speed equals a predetermined value that is kept constant until a location time point at which a tail end of the rolling material reaches a predetermined location upstream of the front group of the roll stands, and is increased according to a predetermined function after the location time point.

17. The control device according to claim 16, further comprising a memory storing the feed forward control signal, and wherein the method further comprises:

adding the feed forward control signal stored in the memory to an output signal of the programmed processor, beginning at the location time point or beginning at a value time point at which the predetermined value is increased, modifying the feed forward control signal stored in the memory in dependence upon the output signal of the programmed processor, detecting a rolling material speed of the rolling material immediately upstream of the front group of the roll stands, and adapting the predetermined function in dependence upon a deviation of the rolling material speed from a reference speed.

18. A rolling mill for rolling a rolling material, comprising:

roll stands, including a front group of the roll stands having a first set of the roll stands in the front group driven by a first drive common to the front group of the roll stands, and a rear group of the roll stands having a second set of the roll stands in the rear group driven by a second drive common to the rear group of the roll stands; and a control device, including at least one hardware processor, configured to control rolling of rolling material according to a method comprising:

rolling front sections of the rolling material first in the front group of the roll stands and then in the rear group of the roll stands, rolling rear sections of the rolling material in the front group of the roll stands during the rolling of the front sections of the rolling material in the rear group of the roll stands, detecting a run-out speed of the rolling material exiting the front group of the roll stands, detecting a run-in speed of the rolling material entering the rear group of the roll stands, and controlling a rear group speed with which the rear group of the roll stands is driven based on a feed-forward signal, such that a relation of the run-in speed to the run-out speed equals a predetermined value that is kept constant until a location time point at which a tail end of the rolling material reaches a predetermined location upstream of the front group of the roll stands, and is increased according to a predetermined function after the location time point.

19. The rolling mill according to claim 18, wherein the roll stands include an additional group of the roll stands upstream of the front group of the roll stands, wherein the method further comprises rolling the rolling material in the additional group of the roll stands, upstream of the front group of the roll stands, prior to the rolling in the front group of the roll stands, and wherein the predetermined location is upstream of the additional group of the roll stands.

20. The rolling mill according to claim 19, wherein the control device further includes a memory storing the feed forward control signal, and wherein the method further comprises:

adding the feed forward control signal stored in the memory to an output signal of the control device, beginning at the location time point or beginning at a value time point at which the predetermined value is increased;

modifying the feed forward control signal stored in the memory in dependence upon the output signal of the control device;

detecting a rolling material speed of the rolling material immediately upstream of the front group of the roll stands; and adapting the predetermined function in dependence upon a deviation of the rolling material speed from a reference speed.

* * * * *